United States Patent [19]

Hübner

[11] Patent Number: 5,018,518

[45] Date of Patent: May 28, 1991

[54] GAS WORK WITH SENSING AND ALARM MEANS

[75] Inventor: Hans-Jörg Hübner, Dortmund, Fed. Rep. of Germany

[73] Assignee: Gesellschaft für Gerätebau mbH, Dortmund, Fed. Rep. of Germany

[21] Appl. No.: 358,304

[22] Filed: May 26, 1989

[30] Foreign Application Priority Data

May 27, 1988 [DE] Fed. Rep. of Germany ..... 3818052

[51] Int. Cl.[5] ..... A62B 7/10; A62B 9/00; A62B 27/00

[52] U.S. Cl. ..... 128/202.22; 128/205.27; 128/205.29; 128/206.12; 128/206.17; 128/206.17

[58] Field of Search ..... 128/202.22, 205.27, 128/205.29, 206.12, 206.17, 206.21

[56] References Cited

U.S. PATENT DOCUMENTS

| | | | |
|---|---|---|---|
| 3,586,486 | 6/1971 | Young Ho Kim | 422/97 |
| 3,902,485 | 9/1975 | Wallace | 128/205.27 |
| 3,911,413 | 10/1975 | Wallace | 340/632 |
| 4,146,887 | 3/1979 | Magnante | 340/632 |
| 4,331,141 | 5/1982 | Pokhis | 128/204.28 |
| 4,338,281 | 6/1982 | Treitinger et al. | 422/98 |
| 4,481,499 | 11/1984 | Arima et al. | 338/34 |
| 4,535,315 | 8/1985 | Sakai | 338/34 |
| 4,579,643 | 4/1986 | Mase et al. | 204/427 |
| 4,828,673 | 5/1989 | Maeda | 204/427 |
| 4,873,970 | 10/1989 | Freidank et al. | 128/202.22 |

*Primary Examiner*—Edgar S. Burr
*Assistant Examiner*—Eric P. Raciti
*Attorney, Agent, or Firm*—Nils H. Ljungman & Associates

[57] ABSTRACT

In accordance with the invention, gas masks have a gas sensor behind the filter. When the filter reaches its allowable absorption limit, the gas sensor emits a signal.

3 Claims, 7 Drawing Sheets

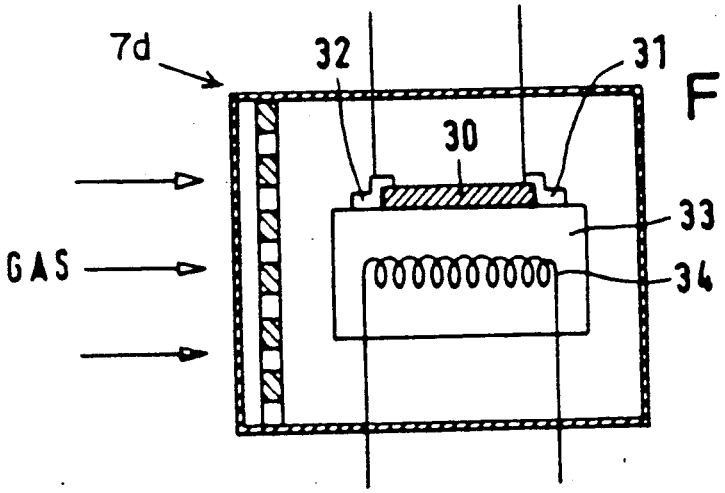
FIG.6
FIG.7
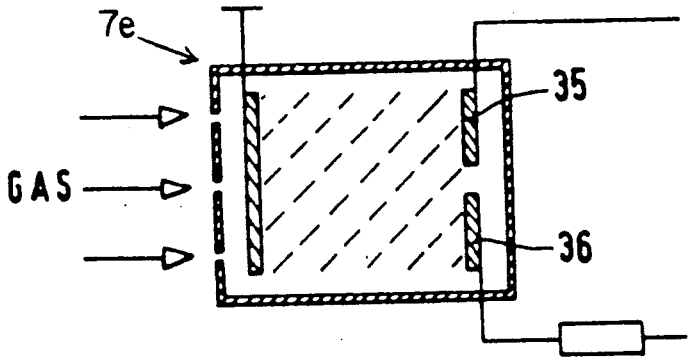

FIG. 9
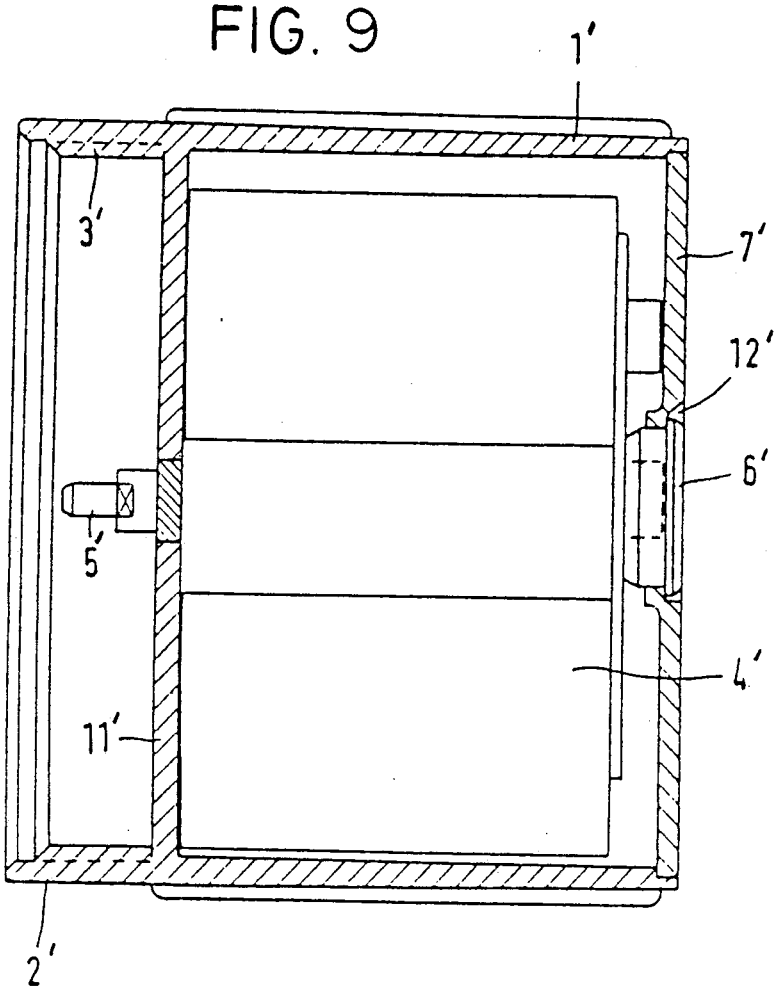
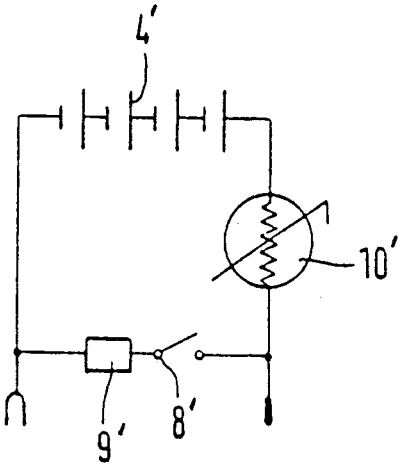
FIG. 11

GAS WORK WITH SENSING AND ALARM MEANS

BACKGROUND OF THE INVENTION

1. Field of the Invention

This invention relates to a gas mask with a filter in the air aspiration apparatus and, in particular,to a gas mask with electrically operated aspiration equipment, which sucks in ambient air and forces it into the gas mask, in which the filter is located ahead of the ventilation aspiration equipment.

2. Description of the Prior Art

Gas masks are used in firefighting, for example, or in areas contaminated by toxic or radioactive aerosols. The use of gas masks is extremely important in battlefield or crisis situations, since the gas mask is used to remove the effects of biological or chemical weapons from the air inhaled. The cleaning is accomplished by means of filters, which are primarily active carbon filters.

All the filters of the prior art have a limited operating time. Therefore, the filters must be replaced after they have been in operation for a specified period of time. The length of this service life is defined so that when the filter is replaced, it still retains sufficient filtering capability.

It is difficult, however, to strictly observe and respond within the specified replacement intervals. Moreover, it is uneconomical to simply replace the filter, regardless of the amount of toxin it has absorbed, after it has reached a specified period of operation.

OBJECT OF THE INVENTION

The object of this invention is to make a filter replacement necessary only after a specified absorption of toxins has been reached, without thereby adversely affecting the safety of the user.

SUMMARY OF THE INVENTION

In accordance with the invention, this is achieved by means of a gas sensor located behind the filter, whereby the gas sensor in contact with the gas changes its electrical resistance or its voltage or its capacitance. The gas sensor is adjusted so that there is an immediate indication of any gas concentration harmful to the wearer of the gas mask in the air being inhaled. Preferably, the gas sensor goes into operation as soon as the concentration of toxic gas approaches the permissible limits.

The objects of the invention are provided in a preferred embodiment thereof including a gas mask having an air aspiration system which has a battery for providing electrical power to various components of the gas mask. The gas mask includes a filter and a device for producing a flow of ambient air into and though the filter for supply to the gas mask. An electric sensor is down stream of the filter for sensing at least one gas in the ambient air of the flow which at least one gas affects the breathing of one wearing the gas mask. The electric sensor is for providing a variable electric signal corresponding to an amount of the gas in the ambient air down stream of the filter. The variable electrical signal is processed to prodice a processed signal corresponding to the amount of the gas. An alarm is responsive to the processed signal for indicating when the amount of the gas is outside of at least one range of amounts of the gas. The alarm is for indicating an inadequacy of the filter for protection of wearing the gas mask.

BRIEF DESCRIPTION OF THE DRAWINGS

The accompanying drawing illustrates various embodiments.

FIG. 6 is a schematic view of a preferred sensor for determining concentrations of toxic gas.

FIG. 7 is a schematic view of a preferred sensor for determining concentrations of carbon monoxide.

FIG. 11 is a schematic of a circuit that may be used, according to the invention, for residual discharge of a battery pack.

DESCRIPTION OF THE PREFERRED EMBODIMENTS

Figure 1:
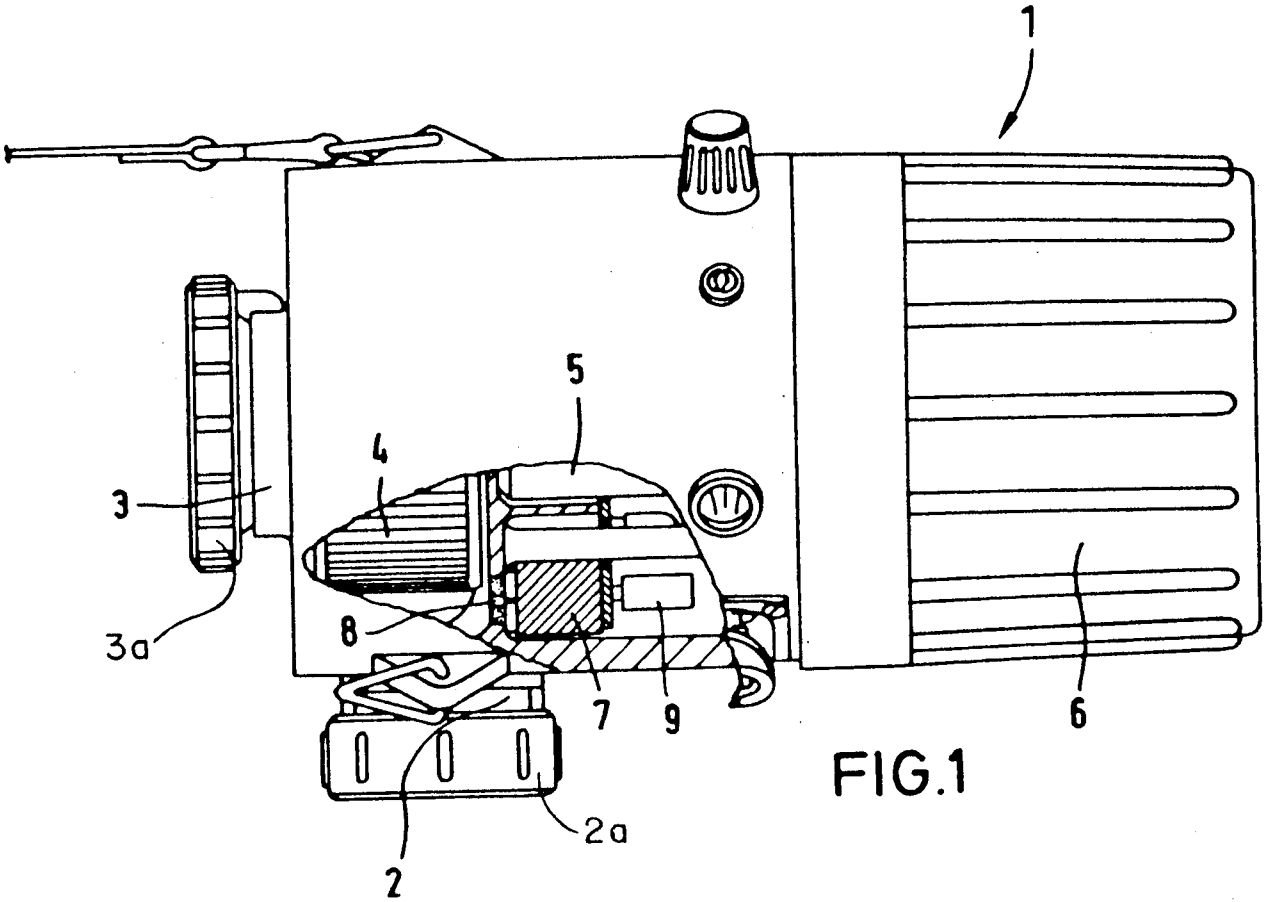
FIG. 1 is a fragmentary, elevational view partially in section of a preferred aspiration apparatus including various features of the invention.
Figure 8:
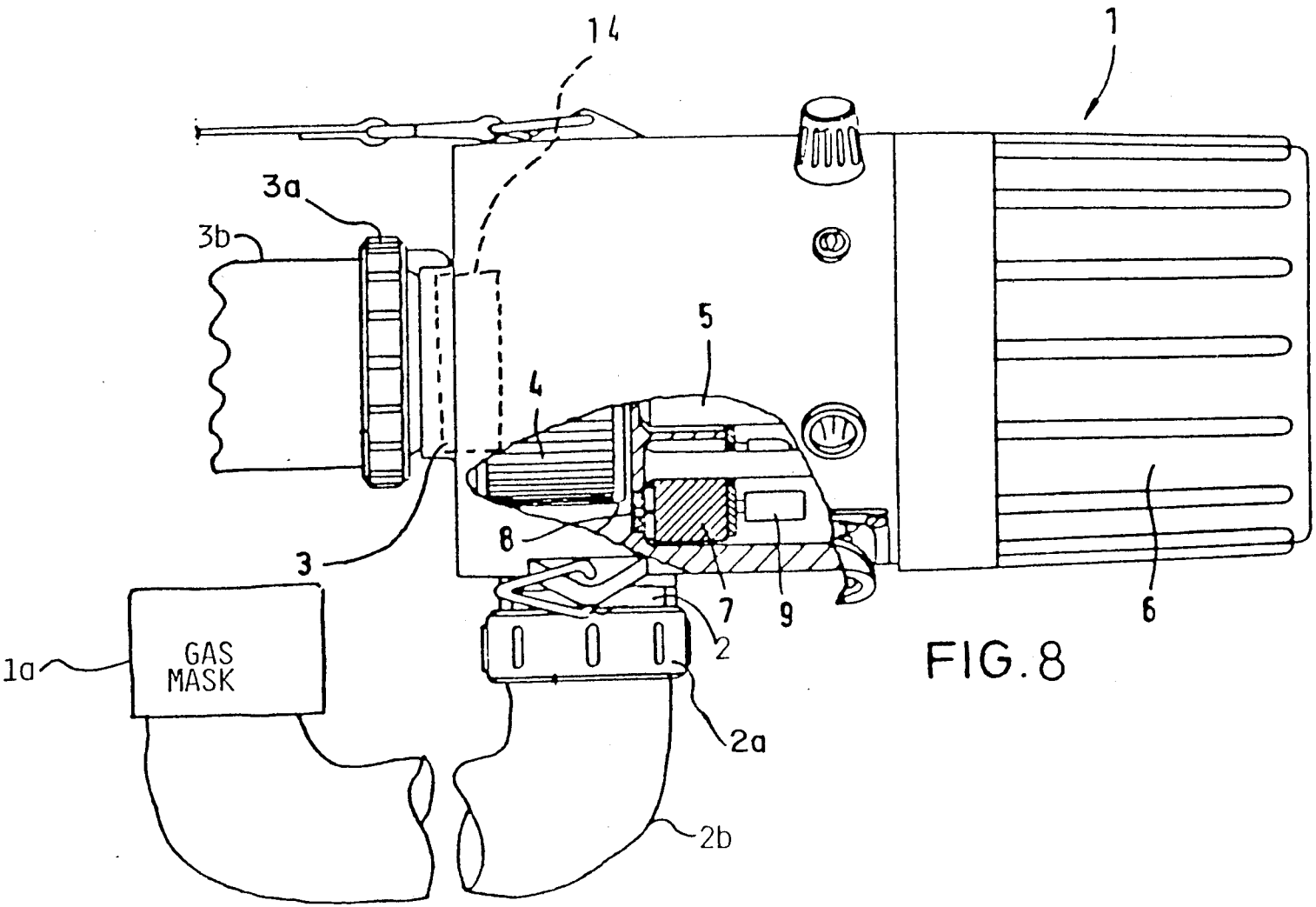
FIG. 8 is a schematic view alike that of FIG. 1 including additional preferred components of the invention. invention, taken generally along the line IX—IX of FIG. 10.

As seen in FIGS. 1 and 8, an aspiration apparatus 1 is for a gas mask 1*a*. During operation, the aspirated air is connected via a flexible hose 2*b* with the gas mask 1*a* surrounding the user's head to the aspiration apparatus 1 by a hose connection tube 2.

The preferred aspiration apparatus 1 for a gas mask has an aspiration connection tube 3. As shown in FIG. 1, the two connections tubes 2 and 3 are closed by means of screw-type closures 2*a* and 3*a*. Prior to the connection of the flexible hose 2b with a coupling 2c to the connection tube 2 as seen in FIG. 8, the closure 2*a* is unscrewed and removed The closure, 3*a* of the connection tube 3 is also unscrewed in order for a filter 14 to be installed therein. The preferred filter 14 can be an active carbon filter, for example, of a type which is well known in the gas mask art. As seen in FIG. 8 a hose 3*b* with a coupling 3*c* may, in an alternative embodiment, also be attached to the connection tube 3 after removal of the closure 3*a* in order to provide the ambient air from a location which is remote from apparatus 1.

The preferred aspiration apparatus 1 allows ambient air to be sucked in through the filter 14, so that ambient air is cleaned in the filter 14.

Figure 10:
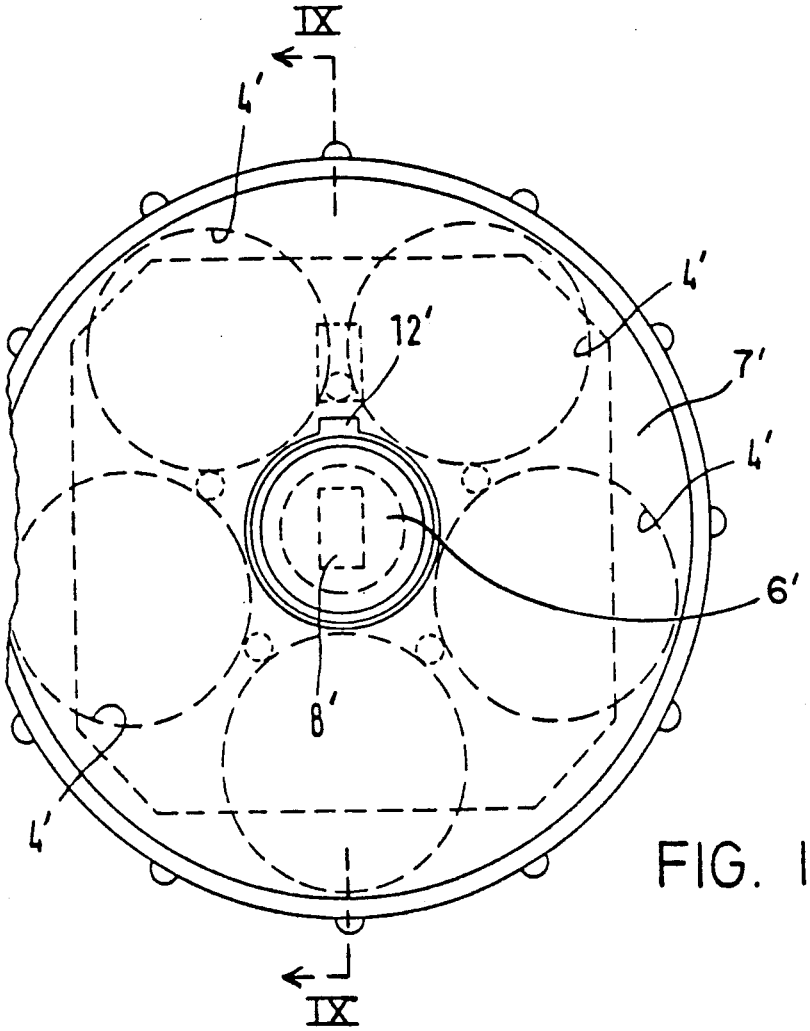
FIG. 10 is a plan view of the bottom of the battery pack of FIG. 9
Figure 12:
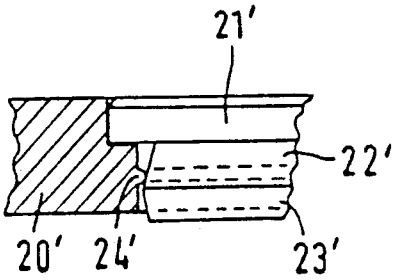
FIG. 12 is a sectional view, with portions broken away, of an alternative plug arrangement of the invention.

The aspiration is produced by means of a finned wheel 4, which is mounted for rotation in the housing of the aspiration apparatus 1 and driven by a motor 5. The preferred motor 5 is an electric motor, which is supplied with low-voltage current by a battery, which is located in the portion 6 of the aspiration apparatus 1. A preferred battery 4' is shown in FIGS. 9 and 10 in a housing 1' which is similar to the portion 6.

In the preferred aspiration apparatus 1, there is provided a gas sensor means 7. The preferred gas sensor means 7 is connected by means of a feed line 8 to the cavity in which the finned wheel 4 rotates.

A preferred electronic system 9 is connected with the preferred gas sensor means 7.

Figure 2:
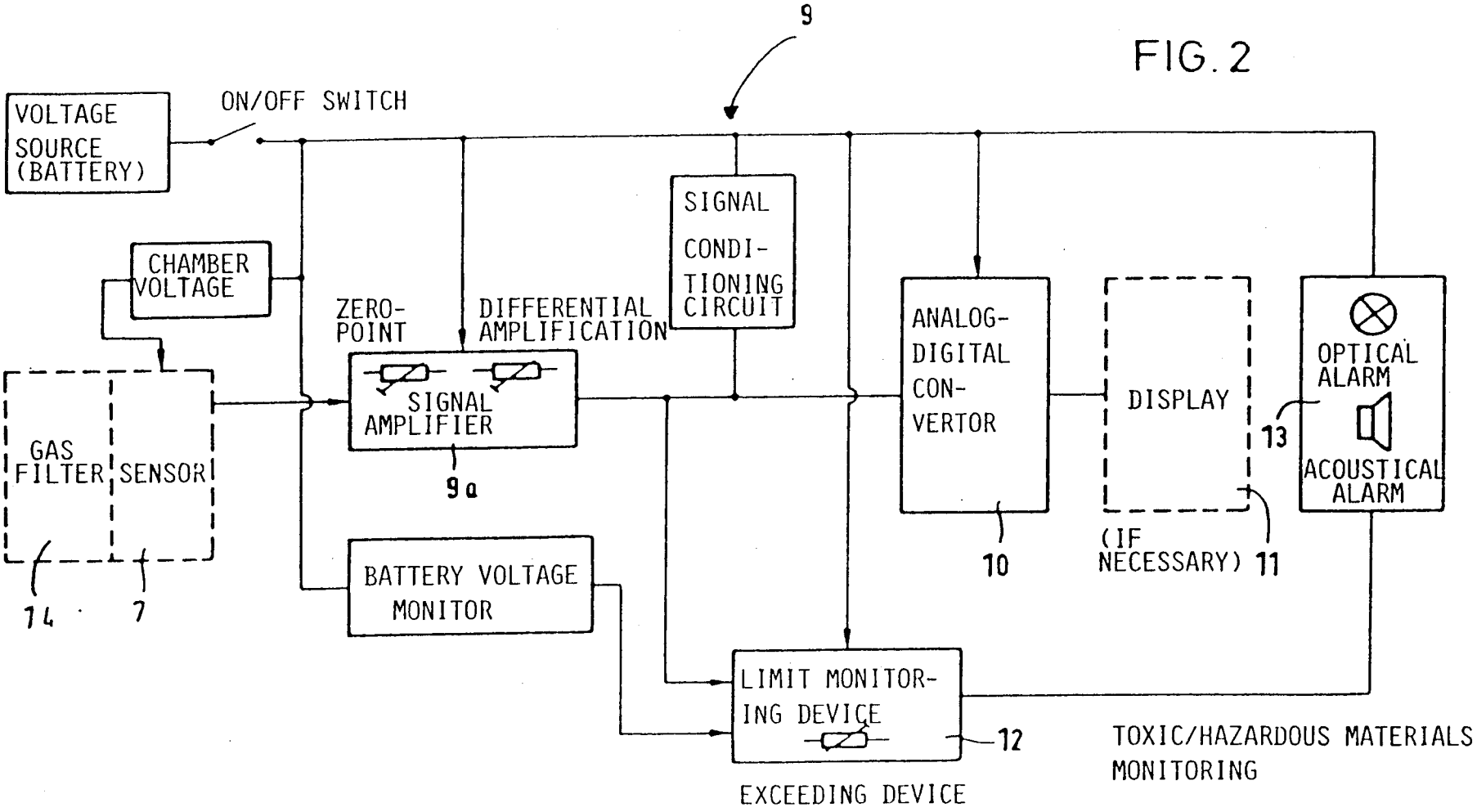
FIG. 2 is a schematic view of a preferred electronic system including various features of the invention.

FIG. 2 shows the interaction of the preferred electronic system 9 and the preferred sensor means 7 in a schematic representation. In FIG. 2, the sensor means 7 transmits a signal to a signal amplifier 9*a* for amplification. The amplified signal travels to an analog-digital converter 10, whose output can appear on a display 11, if such a display 11 is considered necessary and desirable. A signal conditioning circuit insures that the amplified signal is in a proper form for conversion by the analog-digital converter 10.

Parallel to the display 11 is a limit monitoring device 12. The limit monitoring device 12 is likewise connected to the amplified output of the signal amplifier 9*a*. A contact is closed in the limit monitoring device 12 to emit an optical or acoustical alarm 13, as soon as an allowable value as set on a limit exceeding device is exceeded. The limit monitoring device 12 can also be used to monitor the level of the battery voltage, which is essential for the operation of the sensor means 7.

Figure 3:
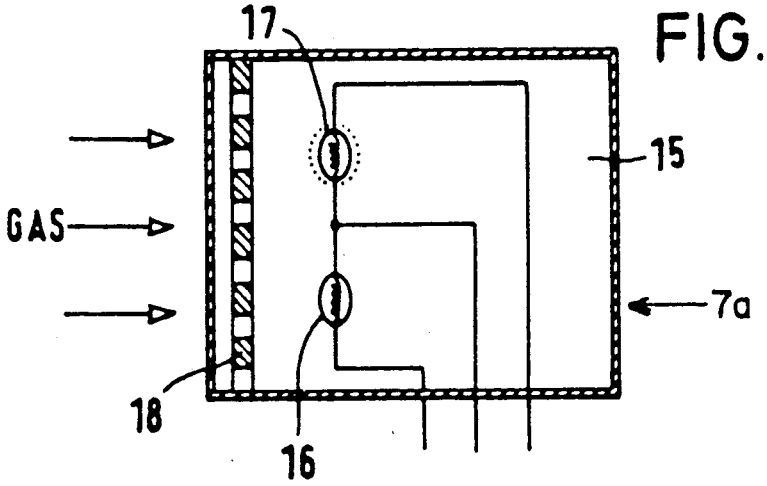
FIG. 3 is a schematic view of a preferred sensor for detecting explosive concentrations of gases.

The preferred gas sensor means 7 is designed for the expected gas or gases. Advantageously, the systems are designed to react in a particularly sensitive manner to the specified gases. For example, FIG. 3 shows a sensor 7*a* for explosive gases.

Pre-requisites for a gas explosion are: combustible gases or vapors, oxygen in sufficient quantity, an ignition source and a specified gas concentration. Combustible gases occur very frequently. They include, for example, acetone, acetylene, ethane, ethyl alcohol, ethylene, ammonia, benzol, n-butane, chlorobenzene, hydrogen cyanide, dimethylether, dioxane-1,4, acetic acid, glycerine, carbon monoxide, methane, methyl chloride, naphthaline, nitrobenzene, phenol, propane, propylene, carbon disulfide, hydrogen sulfide, toluol, vinyl chloride and hydrogen.

Chemical explosions are generally very rapid oxidations. The oxygen required for such explosions is present in sufficient quantity in the ambient air. Likewise, ignition sources are very common and frequently present in the environment. They include lit cigarettes, sparks which occur when electrical contacts close, naterials striking one another, arcs during welding, etc.

However, an explosion occurs only in the presence of a certain quantity or proportion of gas. The concentration must reach a specified minimum value before a gas-air mixture ignites. The sensor 7*a* illustrated in FIG. 3 measures the concentration of such a gas-air mixture. The preferred sensor 7*a* operate according to the principle of "catalytic combustion" or "heat of reaction". The gas-air mixture is directed to a preferred active catalyst 16, in the form of a heated measuring element, by means of diffusion or by means of a measurement gas pump. The higher the concentration of the combustible components, the more the active catalyst 16 of the sensor 7*a* is heated; the active catalyst 16 and a passive element 17, combines to form the branches of a Wheatstone bridge. The bridge tuning is proportional to the gas concentration. A measurement transformer, such as the signal processor 9, receives the signals, processes them and conducts them to the indicator or alarm as shown in FIG. 2.

In FIG. 3, the measurement chamber of the sensor 7*a* is designated 15 and includes the active catalyst 16 and the passive element 17. The gas penetrates a sinter metal surface of the measurement chamber 15, passes through a firewall or fire lock 18, and reaches the active catalyst 16, which acts in the manner described above.

The gas sensor 7*a* illustrated in FIG. 3 requires sufficient oxygen for the catalytic combustion. As the gas concentration increases, however, the proportion of oxygen decreases. When the oxygen decreases, the heating of the elements in the sensor 7*a* decreases, which reduces the accuracy of the measurement of the proportionality of the gas concentration. Consequently, the gas sensor 7*a* illustrated in FIG. 3 is preferably used to determine the lower explosion limit, i.e. the minimum oxygen concentration required for an explosion. There is also an upper explosion limit, which represents the maximum oxygen content at which there is a danger of explosion.

Figure 4:
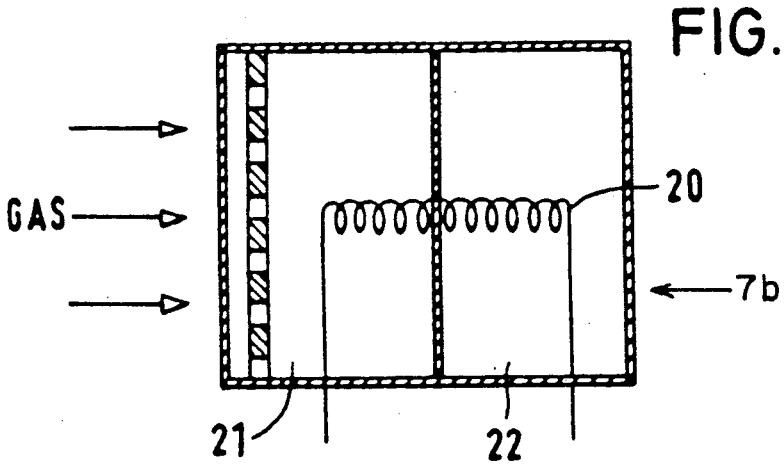
FIG. 4 is a schematic view of a preferred sensor for determining a concentration of combustible gases.

If the gas concentration is to be measured beyond the lower explosion limit, a gas sensor 7*b* like the one illustrated in FIG. 4 is suitable. The gas sensor 7*b* illustrated in FIG. 4 operates according to the "thermal conductivity" principle, and is based on the fact that thermal conductivity of gases changes with concentration. The sensor 7*b* in FIG. 4 is also based on a bridge circuit, in which a heated platinum wire 20 is used as the measurement and comparison sensor. In FIG. 4, the measurement chamber is designated 21, and the comparison chamber 22. The platinum wire 20 is designed as a coil and runs continuously through the measurement chamber 21 and the comparison chamber 22. As in the gas sensor 7*a* in FIG. 3, the gas enters through an appropriately designed housing wall, e.g. made of sinter metal, through a flame.check valve or fine lock, and reaches the platinum wire 20, where it causes different degrees of heating of the platinum wire 20 which is carrying a varying current to provide the basis of the signal. A different sensor for detecting explosive gases is disclosed in U.S. Pat. No. 4,352,099.

Figure 5:
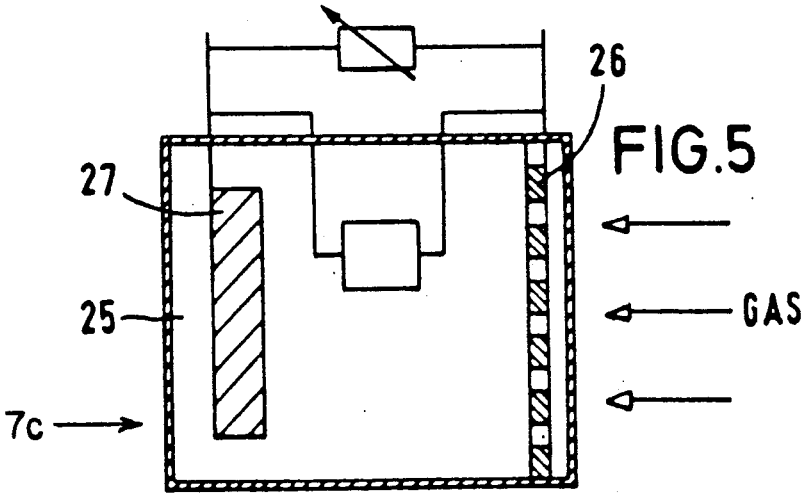
FIG. 5 is a schematic view of a preferred sensor for determining oxygen concentrations

Gases which are neither combustible nor toxic to humans are still dangerous if they contain no oxygen. FIG. 5 illustrates a measurement transmitter or sensor 7*c* for the oxygen concentration. Between the atmospheric air and a basic electrolyte 25, there is a cathode 26 made of an electron-conducting material having a large surface area. On its active surface, a reaction takes place with the oxygen in the gas being measured. The oxygen is thereby decomposed into hydroxyl ions. At the same time, electrical energy or current is released.. The current which flows between cathode 26 and anode 27 is proportional to the amount of oxygen and thus provides the desired signal. The reaction of such a cell is extremely rapid. Other oxygen sensors are disclosed in U.S. Pat. Nos. 4,186,071; 4,272,349; and 4,297,192.

Toxic gases can be particularly dangerous. Frequently occurring gases are, for example, acetaldehyde, formic acid, ammonia, arsine, chlorine, chlorine dioxide, hydrogen cyanide, methylene chloride, fluorine, hydrogen fluoride, formaldehyde, carbon dioxide, carbon monoxide, osmium tetroxide, propane, sulfur dioxide, sulfur hexafluoride, hydrogen sulfide, tetrachlorethane, toluol, chloroform and hydrogen peroxide.

Toxic gases can be measured by means of semiconductor sensors. Chemical adsorption on metal oxide semiconductors plays a role on their surfaces, and causes changes in conductivity, as a function of the gas concentration.

FIG. 6 shows such a gas sensor 7*d*. The metal oxide semiconductor is designated 30 and is held between two electrodes 31 and 32. The reaction is intensified by means of a heating apparatus, which comprises a ceramic body 33 and a heating coil 34 enclosed in the ceramic body 33. The signal indicative of the toxic gas is measured at the electrodes 31 and 32. U.S. Pat. Nos. 4,338,281; 4,509,034; 4,601,914; and 4,816,800 disclose other sensors which employ semiconductors.

FIG. 7 shows a gas sensor *7e* for the indication of carbon monoxide The design of the gas sensor *7e* in FIG. 7 is essentially the same as that of the gas sensor *7c* in FIG. 5, but, instead of a simple anode, there are two electrodes, a reference electrode 35 and a backplate electrode 36 the current flow between the cathode and the electrodes provides a signal indicative of the amount of carbon monoxide present. Carbon monoxide can also be detected by the use of the sensors disclosed in U.S. Pat. Nos. 4,025,412; 4,394,239; and 4,820,386.

Additional gas sensors are disclosed in U.S. Pat. Nos. 4,307,061; 4397,888; and 4,620,918.

It should be clear from the various sensors discussed hereinabove that the preferred invention could include a combination of one or more of such sensors in order to provide various forms of protection for the wearer of the gas mask. Those skilled in the sensor art will understand that while some of the sensors may be combined into a single signal processor such as that generally shown in FIG. 2, some such sensors may require separate signal processors while still being capable of being installed for use with a single alarm system to indicate the inadequacies of the filter for proper protection of the wearer of the gas mask.

Still further, it should be noted that the various sensors shown hereinabove are shown in schematic form. It should be clear that some of the chambers may be provided outlet openings or holes to insure a continuous flow therethrough. Those skilled in the sensing art may, on the other hand, recognize that, with some chamber configuration, that general gas diffusion may be adequate to insure a continuous sampling.

In summary, one aspect of the invention includes a gas mask with filter in the air aspiration apparatus and in particular, a gas mask with an electrically operated aspiration apparatus which sucks in ambient air and forces it into the gas mask, whereby the filter is located ahead of the aspiration apparatus, characterized by the fact that there is a gas sensor behind the filter, whereby the gas sensor in contact with the gas changes its electrical resistance or its voltage or its capacitance.

The gas mask can also be characterized by a measurement chamber 21 to which the gas can be admitted and a comparison chamber 22, whereby a current conductor 20 penetrates both chambers.

The gas mask may further be characterized by a semiconductor 30 to which the gas can have access, and which is part of a circuit.

Also, the gas mask can be characterized by a gas sensor with anode 27 and cathode 26, whereby the cathode is between the gas and an electrolyte 25.

Additionally, the gas mask may be characterized by a gas sensor with a heated measurement element 16 to which the gas can have access, and which together with a passive element 17 forms a Wheatstone bridge FIG. 9 shows the battery pack for an aeration or breathing apparatus. The battery pack has a housing 1', whose connection to the rest of the housing of the aeration or breathing apparatus is designated 2'. In the embodiment, there is a thread 3'. Instead of the thread 3', there can also be a bayonet closure or another type of quick-release closure. Essentially, these closures work on the basis of a tongue and groove, whereby the groove captures the tongue, and by turning the housing 1' in relation to the rest of the housing 2', both housings can be braced or engaged in relation to one another.

The aeration or breathing apparatus also includes a ventilating fan operated with an electric motor. The use of a blade wheel instead of an impeller is advantageous. The ventilation fan in the embodiment is located behind a filter, so that outside air is sucked in through the filter. The purified outside air is transported as breathable air through a flexible hose to a gas mask. Depending on the control of the ventilating fan, the fan just overcomes the flow resistance of the air in the filter. However, the ventilating fan can also be operated with such force that an overpressure develops in the gas mask. Typical such apparatus are disclosed in U.S. Pat. Nos. 4,549,542, 4,590,951 and 4,646,732, the disclosure of which are intended to be incorporated herein by reference.

Optionally, the gas mask can be part of an overall protective suit (not shown), or the aeration or breathing device can be connected to the protective suit as an air conditioning apparatus. Typical of such suits that could benefit by this invention are disclosed in U.S. Pat. Nos. 4,146,933 and 4,458,680, the disclosure of which are also incorporated herein by reference.

The battery pack illustrated in FIG. 9 has five lithium batteries 4' with a power of 7 to 10 Ampere hours (Ah) at 2.8 to 2 Volts (V). The lithium batteries are connected in a series and can be connected by means of a plug 5' to the aeration apparatus. Accordingly, there is a socket for the plug 5' in the corresponding end of the aeration or breathing apparatus housing.

All the lithium batteries 4' have a steel jacket. Each steel jacket has a predetermined breaking point which opens if an unacceptably high pressure accumulates, and allows the gases causing the pressure to escape. The gases then flow toward a plug 6' in the base 7' of the housing 1'. The plug 6', as shown in FIG. 10, has a circular shape and is force-fitted into the base 7'. The force fit is designed so that the plug cannot come loose by itself as a result of temporary vibrations of the aeration or breathing apparatus, even if the aeration or breathing apparatus is dropped, but yields immediately to the pressure of the oncoming gases. Then the gases can flow out, and the danger of explosion is eliminated.

In another embodiment illustrated in FIG. 10, the plug 21' is provided with a double cone which is thicker in the middle and tapers toward the ends. The taper is between 0.1 and 1 degree to the center axis, and is a function of the plastic used and the desired opening pressure. The plug 21' interacts with a spring 24' of the housing base 20'. The spring 24' is between 0.05 and 0.2 mm thick. Thus the plug and bottom parts, which determine the opening pressure, are so small that their special function is difficult to see with the naked eye.

The direction of flow of the gases, when the aeration or breathing apparatus is worn on the hip, is not directed toward the user of the apparatus.

The plug 6' can also be opened by hand, in the absence of a gas discharge. That is the case when the battery pack is largely discharged, and can no longer be used as a sufficient energy source for the aeration or breathing apparatus. Opening the plug 6' makes a switch 8' accessible. By activating the switch 8', a removal of the residual charge of the batteries takes place. For that purpose, the batteries illustrated in FIG. 11 are connected as follows: the switch 8' closes a circuit which includes, in addition to the batteries 4', a resistance 9' and a poly-switch 10'. The resistance 9' prevents a short circuit when there is a high current or a high amount of heat produced by the batteries 4'. The switch 10' is a thermostatic switch, which interrupts the circuit if excessive heating occurs during the residual discharge, and closes again after sufficient cooling has taken place.

The residual discharge makes certain that the battery pack can be discharged completely and easily.

NHL-KK-02

The invention also provides that the housing 1' has a welded base 7'. Optionally, the base 7' can also be an integral part of the housing 1'. In that case, the wall designated 11' can be used.

To open the plug, the opening for the plug 6' has a recess 12'. The recess 12' is designed so that the seal between the base 7' and the plug 6' is not endangered, but a screwdriver or a similar tool can be pushed under one edge of the plug 6', and the plug 6' can be pried out.

It should be noted that gas masks are generally known as BC gas masks. The purpose of these masks is to produce harmless and breathable air from contaminated ambient air. For this purpose, there are filters in the breathing passages of the gas mask. The filters are customarily activated carbon filters. To overcome fluid flow resistance of such filters, the user must apply so much energy that the use of gas masks is very strenuous. To overcome this flow resistance, the prior art includes the use of auxiliary aeration equipment. Such auxiliary aeration equipment comprises a fan, which is preferably located behind the filter, and therefore acts as a suction fan and pulls the breathing air through the filter. Optionally, the suction draft or flow can be adjusted so that an overpressure develops in the gas mask in relation to the ambient atmosphere. That can have various advantages.

For the operation of an aeration or breathing apparatus, German Laid Open Patent Application No. 35 23 097 proposes the use of batteries. In that case, for the evaluation of a battery, its weight coefficient is a criterion of particular importance. The weight coefficient is the current supplied, taking the weight of the battery into consideration.

German Utility Model No. G84 36 184 discloses a housing for energy supply units which have batteries, whereby this housing is designed as an element to provide protection against a possible overpressure inside the housing, with a closing by means of a rupture disc and an aeration hole.

U.S. Pat. No. 4,484,691 discloses the manufacture of lithium batteries with a metal jacket, which has a predetermined breaking point.

One aspect of the invention may be directed to the use of particularly efficient batteries for an aeration or breathing apparatus. The invention is therefore based on lithium batteries or similar batteries. Lithium batteries have so far not been used in aeration or breathing equipment for gas masks. Before lithium batteries can be used, there are significant problems which must one overcome. These problems include the operation pressure of such batteries. The operating pressure can easily be 5 or 6 Bar. The operating pressure, however, can increase to an extreme degree. That is the case when a short circuit occurs. However, other material defects or operating errors can produce the same effect. In such a case, there is a danger of explosion. The danger of explosion is all the greater, since the lithium batteries must be equipped with a metal jacket to control the normal operating pressure. For the above reason, lithium batteries or similar batteries have so far not been used for aeration or breathing equipment.

For one embodiment of the invention it may be assumed that lithium batteries basically have a predetermined breaking point. When assembled as part of a battery pack, the discharge direction is undefined. The battery pack housing must channel the discharge in a direction which does not pose any danger. A rupture disc is frequently unsuitable for this purpose. Because the rupture disc must be designed thin enough for low discharge pressures, it can be destroyed without a discharge occurring, such as during rough handling of the aeration or breathing apparatus. By means of the plug, in accordance with this invention, the opening pressure can be set with much greater precision than a rupture disc, e.g. to a pressure between 1 and 5 kg.

The arrangement of the plug on the bottom of the battery pack, in accordance with the invention, also has the effect that the gases which are discharged are not directed toward the person wearing the aeration or breathing apparatus.

An additional advantage of the plug is the controlled possibility of access after the battery has been used. At that time, the plug can be removed to prevent an explosion during storage of the used battery, until it is completely discharged.

The closing can optionally be formed by a circular opening in the bottom of the housing, which is closed by a plug. The plug sits in the opening, e.g. with a force fit. The opening pressure is set higher than the force fit. Such a pressure can also be produced by means of a gasket (not shown), which is located on the plug or on the base of the container, and which produces the required application pressure.

It is advantageous if the plug is removable. Then the battery housing can be ventilated. To open the plugged housing, the plug can be provided with an edge, for example, and there can be a recess in the base of the housing, by means of which a suitable tool, e.g. a screwdriver, can be inserted under the edge of the plug, and the plug pried out.

Preferably, under the plug there is also a switch which is part of a circuit, by means of which the batteries can be completely discharged. Only when the battery has been completely discharged is it certain that lithium batteries will not experience an undesirable heating for the above reasons. In other words, after the use of lithium batteries, the residual battery charge is discharged in accordance with the invention.

There is a resistance in the circuit for the residual discharge operation. The resistance prevents a short circuit situation. There is also another switch which opens if excessive heating occurs, and thus interrupts the residual discharge. Preferably, a reversible switch is used, e.g. one which works on the principle of a bimetallic strip. These switches are also called poly-switches.

Accordingly, one aspect of the invention may reside broadly in an apparatus for a gas mask or aeration device comprising a battery pack, a housing for the battery pack, the housing including a device to permit a build-up of pressure therewithin, and a device to protect against overpressurization of the housing due to pressure produced by the battery pack.

In summing up, one aspect of the invention may reside in a battery pack for aeration apparatus, in particular for a gas mask and/or protective suit, whereby the aeration apparatus produces the pressure required to overcome the flow resistance and/or an overpressure, and there is a closure, which opens when an unacceptable internal battery pressure is reached, on the base of the battery pack, which comprises a plug and/or circuit for the residual discharge of the battery.

Another aspect of the invention may reside in a battery pack in which the closure has a circular shape when view from above.

An additional aspect of the invention may reside in a battery pack in which a spring and/or double cone plug may be used as the closing parts for the battery pack.

A further aspect of the invention may reside in a battery pack in which the plug has an edge, and the base of the battery pack has a recess.

Another aspect of the invention may reside in a battery pack having a switch for the residual discharge of the batteries located underneath the plug.

A yet further aspect of the invention may reside in a battery pack having a resistance and a poly-switch in the circuit for removing the residual battery charge.

An additional aspect of the invention may reside in a battery pack having a quick-release closing for the connection to the aeration apparatus.

Another aspect of the invention resides in a battery pack having a housing with an insertable base.

All the patents mentioned hereinabove are incorporated by reference as if included in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A gas mask having air aspiration means, said gas mask comprising:

battery means for providing electrical power to various components of the gas mask;

filter means, said filter means having an upsteam side in communication with the ambient air and a downstream side in communication with a user of the gas mask;

electrically operated means for producing a flow of ambient air into and through said filter means for supply to the user of the gas mask;

electric sensing means disposed on said downstream side of said filter means for sensing at least one gas in the flow of ambient air that affects the breathing of the user of the gas mask;

said electric sensing means comprising means for providing a variable electrical signal corresponding to the amount of said at least one gas present in the ambient air downstream of said filter means;

processing means for processing said variable electrical signal to produce a processed signal corresponding to said amount of said at least one gas;

alarm means responsive to said processed signal for providing an alarm when said amount of said at least one gas is outside of a range;

said alarm means being for indicating an inadequacy of said filter means for protection of the user of the gas mask;

wherein said at least one gas consists essentially of oxygen and wherein said electric sensing means comprises oxygen decomposing means.

2. The gas mask according to claim 1, wherein said alarm means comprises means for providing said alarm signal when the oxygen in ambient air is below a specific level for the protection of one wearing the gas mask.

3. The gas mask according to claim 1, wherein said electric sensing means comprising oxygen sensing means comprising:

an electrode;

a cathode, said cathode comprising an electron conducting material; and means for contacting said both of said electrode and said cathode with the ambient air;

whereby oxygen in the ambient air is decomposed into Hydroxyl ions which flow between said electrode and said cathode.

* * * * *

UNITED STATES PATENT AND TRADEMARK OFFICE

CERTIFICATE OF CORRECTION

PATENT NO. : 5,018,518

DATED : May 28, 1991

INVENTOR(S) : Hans-Jörg HÜBNER

It is certified that error appears in the above-identified patent and that said Letters Patent is hereby corrected as shown below:

In column 2, line 15, after 'concentrations', insert --.--.

In column 2, line 22, before 'invention,', insert --Figure 9 is a sectional view of a battery pack of the--.

In column 2, line 25, after '9', insert --.--.

In column 2, line 45, after 'coupling', delete "2c" and insert --2a--.

Signed and Sealed this

Ninth Day of March, 1993

*Attest:*

STEPHEN G. KUNIN

*Attesting Officer*

*Acting Commissioner of Patents and Trademarks*